United States Patent [19]

Haller et al.

[11] Patent Number: 4,538,550

[45] Date of Patent: Sep. 3, 1985

[54] CASING SEAL ATTACHMENT

[75] Inventors: Kurt H. Haller, Akron; Raymond G. Kidaloski, Canal Fulton, both of Ohio

[73] Assignee: The Babcock & Wilcox Company, New Orleans, La.

[21] Appl. No.: 607,092

[22] Filed: May 4, 1984

[51] Int. Cl.[3] ..... F22B 15/00

[52] U.S. Cl. ..... 122/235 G; 122/235 A; 122/235 F; 122/510; 122/512

[58] Field of Search ..... 122/235 R, 235 A, 235 C, 122/235 D, 235 F, 235 G, 235 K, 493, 494, 496, 510, 511, 512

[56] References Cited

U.S. PATENT DOCUMENTS

| | | | |
|---|---|---|---|
| 1,741,718 | 2/1929 | Jacobus | 122/235 F |
| 3,357,408 | 12/1967 | Patterson | 122/510 |
| 3,838,665 | 10/1974 | Astrom | 122/235 A |
| 3,868,927 | 3/1975 | Losel et al. | 122/235 A |
| 4,123,994 | 11/1978 | Gersch et al. | 122/510 |
| 4,347,810 | 9/1982 | Rees | 122/510 |

FOREIGN PATENT DOCUMENTS

| | | | |
|---|---|---|---|
| 2740937 | 3/1979 | Fed. Rep. of Germany | 122/235 K |
| 132003 | 10/1979 | Japan | 122/512 |

*Primary Examiner*—Albert J. Makay
*Assistant Examiner*—Steven E. Warner
*Attorney, Agent, or Firm*—Robert J. Edwards

[57] ABSTRACT

A transition seal plate for connecting a casing to a membrane wall of a vapor generator. The plate has a generally corrugated edge which is weld connected to the membrane wall and is formed with arcuate surfaces which overlap circumferential surface portions of the tubes within the membrane wall, and protrusions which project into the spaces between the circumferential surface portions.

5 Claims, 10 Drawing Figures

CASING SEAL ATTACHMENT

BACKGROUND OF THE INVENTION

1. Field of the Invention

This invention relates to vapor generators and, more particularly, to an improved transition means for sealingly attaching a casing to a water-cooled membrane wall of the type employed in vapor generators used to produce steam in electric or industrial power plants.

Most modern vapor generators have water-cooled wall panels known as membrane walls. The membrane walls are composed of rows of vertically extended tubes, laterally spaced on centers wider than the tube diameter, which are connected by flat metal bars known as membranes. These bars are positioned 180° apart on the outside surface along the length of the tubes and continuously welded thereto and to adjacent tubes so as to form a continuous wall surface comprising an alternate succession of elongate circular tube surfaces and elongated flat membrane surfaces that are stepped inwardly of the outermost surface of the tubes defining intervening spaces between the tubes. The welds may be formed by various known means and are usually formed on both sides of the membrane wall.

Metallic sheets or plates, known as casing, are attached to the membrane wall to form a gas-tight cased enclosure, for example, such as a windbox for housing the vapor generator's burners and for distribution of combustion air. It is essential that the casing be connected to the membrane wall in a gas-tight manner.

2. Description of the Prior Art

At present, connection of the casing and membrane wall is accomplished by the placement of short blocks of filler bar in the spaces between the tubes, adjacent the outer side of the membrane bars. An arrangement in which filler bars are welded in place between tubes is disclosed, for example, in U.S. Pat. No. 3,357,408. The filler bars are horizontally and vertically seal welded between adjacent tubes to provide a flush, continuous surface transversely across the tubes and the intervening spaces. The casing, in turn, is seal welded to the filler bars and tubes. This type of structural arrangement stiffens the tubes and restricts the ability of the tubes to expand and contract.

During operation of the vapor generator, considerable temperature differences between the membrane wall and the casing subject them to different amounts of thermal expansion. The stiffened arrangement, moreover, has been found to be quite sensitive to accelerated temperature excursions, such as are experienced in some cycling vapor generators during changes in the vapor generator's operating conditions, and may eventually lead to excessive thermal stresses and resultant tube failures.

SUMMARY OF THE INVENTION

This invention is directed to an improved seal arrangement for sealingly interconnecting a casing and a membrane wall in a manner which more readily accommodates thermal differentials therebetween.

An elongated transition plate, in accordance with the invention, is provided with a first lengthwise edge that has a plurality of arcuated saddles and protrusions formed in alternate succession along the edge. The plate is edge welded gas-tight to the membrane wall with each of the saddles overlapping a circumferential portion of one of the tubes. The casing, in turn is weld connected to the transition plate.

In accordance with a feature of the invention, the saddles and the protrusions extend from the first lengthwise edge, substantially parallel to the tubes, for a distance less than the width of the plate and meld into a planar lower skirt of the plate. Each saddle has a curvature with a radius at the first lengthwise edge which remains constant along the centerline of the saddle through the length of the distance for which the saddle extends from the first lengthwise edge, and each of the protrusions has a depth which diminishes as the distance from the lengthwise edge increases. The plate, accordingly, is preferably provided with a second lengthwise edge which is parallel to the first lengthwise edge, and is a straight edge. A lateral surface portion of the plate adjacent the first lengthwise edge, preferably abuts against a portion of the tube surface and the membrane surface.

The various features of novelty which characterize the invention are pointed out with particularly in the claims annexed to and forming a part of this disclosure. For a better understanding of the invention, its operating advantages, and the objects attained by its uses, reference is made to the accompanying drawings and descriptive matter in which preferred embodiments of the invention are illustrated.

DESCRIPTION OF THE PREFERRED EMBODIMENT

Figure 1:
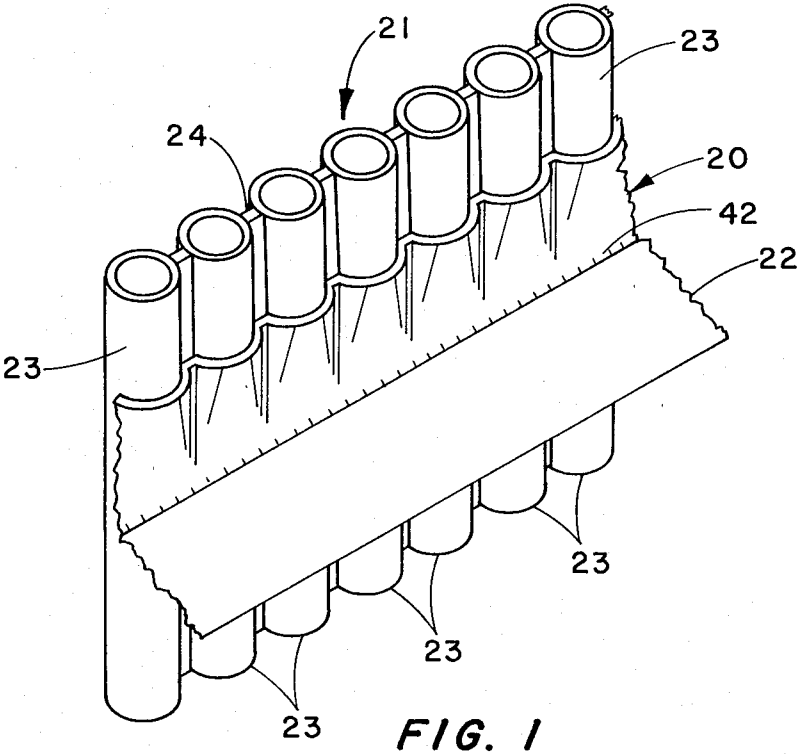
FIG. 1 is a perspective view of a fluid-cooled membrane wall and casing interconnected by a transition seal plate.
Figure 3:
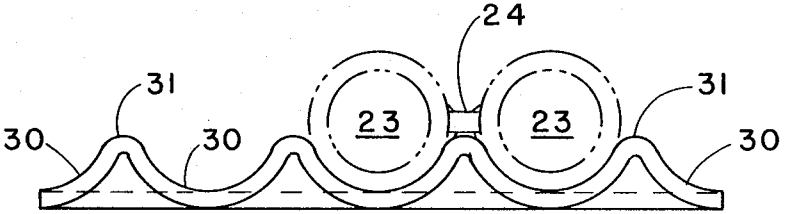
FIG. 3 is a plan view of the plate of FIG. 2 including a section of membrane wall.
Figure 2:
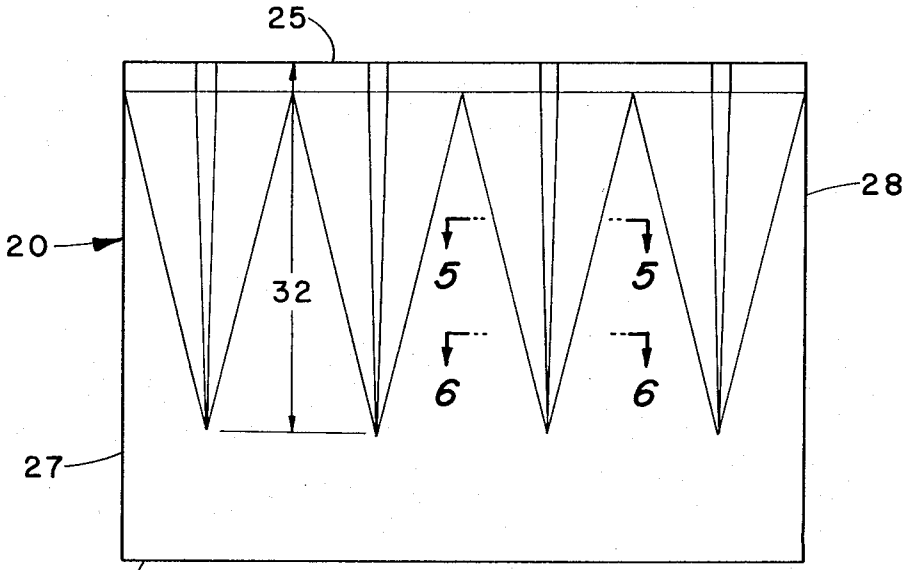
FIG. 2 is a sectional front elevation view of a transition seal plate according to the invention.

Referring now to the drawings wherein like reference numerals designate like or corresponding parts throughout the several views, there is shown in FIG. 1 a perspective illustration of a portion of a transition seal plate 20, a section of a membrane wall 21 and a casing 22.

The membrane wall 21 is composed of tubes 23, only several of which are shown for clarity, arranged in a row with their longitudinal axes in parallel. The tubes 23 are interconnected by a plurality of flat elongated bars 24. The bars 24, also referred to as membranes, are welded to each tube 23 at surfaces approximately 180° apart. The sides of the bars 24 are continuously welded to tubes 23 and are disposed along a common plane extending through the row. The plane is indented relative to the outer surface of the tubes and extends through the centerline of each tube within the row. This, each face of the wall comprises a surface with longitudinally extending semi-circular or circumferential surfaces and intervening planar surfaces.

A plate construction in accordance with a preferred embodiment of the invention is shown in FIGS. 2–6. The plate 20 is a generally rectangular sheet of metal having mutually opposing lengthwise upper and lower edges 25 and 26 and widthwise edges 27 and 28. The upper lengthwise edge 25 follows a generally corrugated contour and includes a plurality of arcuate saddles 30 meeting in protrusions 31 which are formed in alternate succession at equally spaced intervals along edge 25. The saddles 30 are shaped to conform to the shape of the tubes 23. The protrusions 31 are designed to project into the spaces between the adjacent tubes and, at edge 25, have a depth sufficient to allow the protrusion to abut against the membrane bar 24. The lower lengthwise edge 26 is a straight edge.

Figure 4:
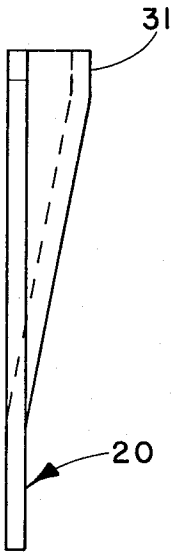
FIG. 4 is a sectional side elevation view of the plate of FIG. 2.
Figure 5:
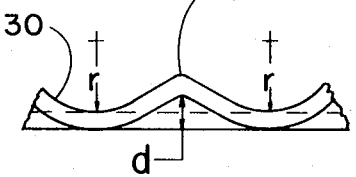
FIG. 5 is a sectional view of the plate of FIG. 2 taken along lines 5—5.
Figure 6:
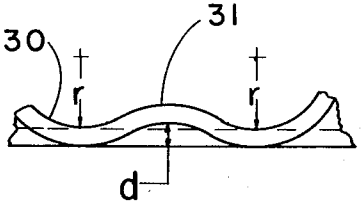
FIG. 6 is a sectional view of the plate of FIG. 2 taken along lines 6—6.

The saddles 30 and protrusions 31 extend a distance 32 from upper edge 25. The depth "d" of the protrusions diminishes and each saddle and protrusion gradually tapers into the plane of the bottom collar or skirt of the plate 20, as best shown in FIGS. 4–6, as the distance from the upper edge increases. Thus, the radius of curvature "r" of the saddle 30 at the upper edge 25 is constant along the vertical centerline of the saddle 30 but the curvature of the saddle 30 on each side of the centerline diminishes toward the plane of the flat portion of the plate 20 as the distance from the upper edge 25 increases.

Without limiting the inventive arrangement to any particular tube size, spacing or type of vapor generator, a plate 20 may be exemplified by the following dimensional data.

Typically, a transition plate for a membrane wall having $2\frac{1}{2}$ inch (63.5 mm) outer diameter tubes on 3 inch (76.2 mm) centers would comprise a steel sheet having a length of approximately $2\frac{1}{2}$ feet (762 mm) from edge 27 to edge 28 and a width of approximately 9 inches (approximately 230 mm) from edge 25 to edge 26. The first $\frac{1}{2}$ inch (12.2 mm) from the upper edge 25 of the plate would be designed to abut against the surfaces of the membrane wall. The saddles and protrusions would extend on an overall length of 7 inches (177.8 mm) from the upper edge 25 and the remaining 2 inches (50.8 mm) of the plate, to lower edge 26, would be flat. The radius of curvature of the saddles 30, at the upper edge 25, would be approximately 1 5/16 inches (approximately 33 mm).

Figure 8:
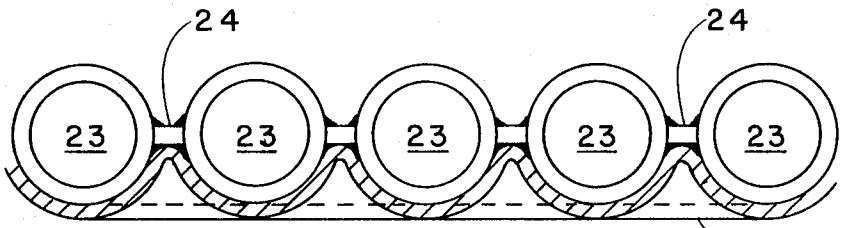
FIG. 8 is a plan view, partly in section, of the arrangement of FIG. 7.
Figure 7:
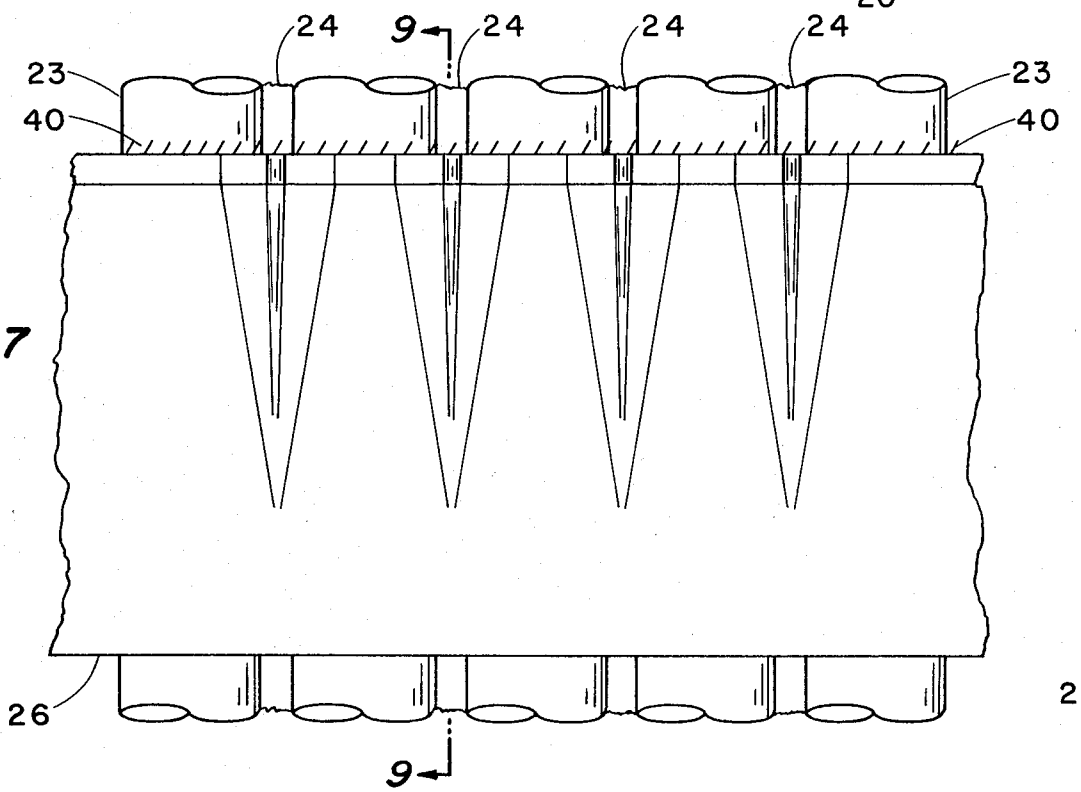
FIG. 7 is a front elevation view of a transition seal plate connected to a membrane wall.

In operation, a seal plate 20 is mounted to a membrane wall 21 as shown in FIGS. 7 and 8. The saddles 30 and tubes 23 are aligned so that the saddles 30 overlap the tubes and the protrusions project into the spaces between the tubes. A lateral wall portion of the plate 20 adjacent to the upper edge abuts against the membrane wall. Thus, at the upper edge 25, the saddles 30 abut against the tubes 23 and the protrusions 31 abut against the membranes 24.

Figure 10:
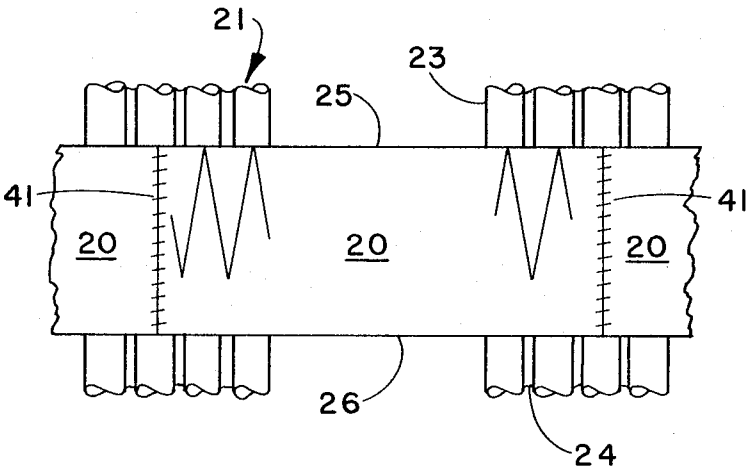
FIG. 10 is a schematic representation of three plates, according to the invention, connected end to end as well as to a membrane wall.

The plate 20 is integrally attached to the membrane wall 21 by a weld 40 formed along the upper lengthwise edge 25 of the plate 20. A number of plates 20 may be connected along their respective widthwise edges 27, 28 by the formation of a weld 41 which extends from the upper edge 25 to the lower edge 26 as is schematically illustrated in FIG. 10. The plates 20, therefore, can be arranged continuously about the periphery of the vapor generator.

Figure 9:
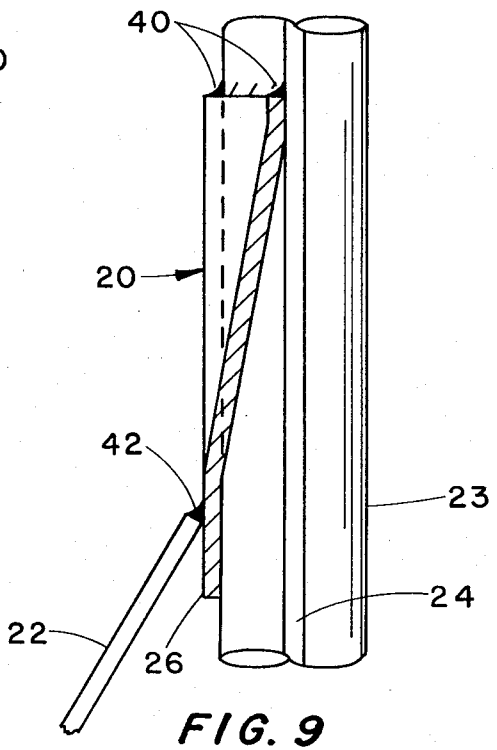
FIG. 9 is a side elevation view of the arrangement of FIG. 7 taken along line 9—9.

As best shown in FIGS. 1 and 9, the casing 22 is seal welded along its upper edge to the plate 20 along a weld line 42 between the lower edge 26 and the point at which the saddles and the protrusions meld into the plane of the planar bottom portion or skirt of the plate 20.

Thus, the casing is not directly welded to any portion of the membrane wall and the plate 20 is only welded along a horizontally extending weld line.

Due to allowable deformation in plate 20, the corrugated upper edge 25 which follows the tube contour is capable to more readily accommodate the unequal expansion resulting from thermal differentials between the membrane wall and casing, than the more rigid prior art filler bar method of attaching the casing and membrane wall.

The foregoing description has been directed to a particularly preferred embodiment of the present invention for purposes of explanation and illustration. It should be recognized, however, by those skilled in the art that modifications and changes in the invention may be made without departing from the scope and spirit of the invention. It is therefore intended that the following claims cover all equivalent modifications and variations as fall within the scope of the invention as defined by the claims.

The embodiments of the invention in which an exclusive property or privilege is claimed are defined as follows:

1. An improved transition seal arrangement for sealingly connecting a casing to a wall of a vapor generator, the wall being of the type having a plurality of parallel, laterally spaced tubes and a plurality of bars disposed between and weld united to adjacent tubes to define a wall surface with longitudinally extending circumferential surfaces and intervening planar surfaces, wherein the improvement comprises an elongated plate welded gas-tight to the wall along a lengthwise edge and weld connected gas-tight to the casing, the lengthwise edge having a plurality of arcuate saddles and protrusions formed in alternate succession along said edge, each of said saddles overlapping a circumferential portion of one of the tubes and wherein the saddles and the protrusions extend from the lengthwise edge, substantially parallel to the tubes, for a distance less than the width of the plate, the protrusions having a depth which diminishes as the distance from the lengthwise edge increases.

2. An improved transition seal arrangement, as recited in claim 1, further comprising a plurality of the plates continuously laterally mounted along the wall, each of said plates having widthwise edges weld united to a widthwise edge of a laterally adjacent plate.

3. An improved transition seal arrangement, as recited in claim 1, wherein the saddles and the protrusions adjacent the lengthwise edge abut respectively against the circumferential surfaces and the planar surfaces.

4. An improved transition seal arrangement, as recited in claim 1, wherein each of the saddles has a curvature having a radius at the lengthwise edge which remains constant along the centerline of the saddle through the length of the distance for which the saddle extends from the lengthwise edge.

5. An improved transition seal arrangement, as recited in claim 1, wherein the plate includes a second lengthwise edge parallel to the first-mentioned lengthwise edge, and wherein the plate is flat intermediate the second lengthwise edge and the said distance which defines the extent of the saddles and the protrusions from the first-mentioned lengthhwise edge.

* * * * *